United States Patent [19]

Heasley, Raymond E.

[11] Patent Number: 4,982,955

[45] Date of Patent: Jan. 8, 1991

[54] EXERCISE DEVICE

[76] Inventor: Heasley, Raymond E., 38 Silver La., McKees Rocks, Pa. 15136

[21] Appl. No.: 313,589

[22] Filed: Feb. 21, 1989

[51] Int. Cl.[5] ..... A63B 21/062

[52] U.S. Cl. ..... 272/118; 272/134; 272/DIG. 4

[58] Field of Search ..... 272/117, 118, 134, DIG. 4

[56] References Cited

U.S. PATENT DOCUMENTS

| | | | |
|---|---|---|---|
| 374,496 | 12/1887 | Reach | 272/118 |
| 1,166,304 | 12/1915 | Albert | 272/117 |
| 3,640,527 | 2/1972 | Proctor | 272/118 |
| 3,856,297 | 12/1974 | Schnell | 272/117 X |
| 3,912,261 | 10/1975 | Lambert | 272/118 |
| 4,199,139 | 4/1980 | Mahnke et al. | 272/118 |
| 4,256,302 | 3/1981 | Keiser | 272/118 |
| 4,407,495 | 10/1983 | Wilson | 272/117 |
| 4,511,137 | 4/1985 | Jones | 272/118 |
| 4,600,189 | 7/1986 | Olschansky et al. | 272/118 |
| 4,603,855 | 8/1986 | Sebelle | 272/117 |
| 4,621,807 | 11/1986 | Stramer | 272/117 |
| 4,627,616 | 12/1986 | Kauffman | 272/134 X |
| 4,709,920 | 12/1987 | Schnell | 272/117 |
| 4,711,448 | 12/1987 | Minkow et al. | 272/118 |
| 4,721,303 | 1/1988 | Fitzpatrick | 272/117 |
| 4,763,897 | 8/1988 | Yakata | 272/118 |
| 4,834,396 | 5/1989 | Schnell | 272/117 |

FOREIGN PATENT DOCUMENTS

| | | | |
|---|---|---|---|
| 2213440 | 10/1973 | Fed. Rep. of Germany | 272/118 |
| 2814653 | 10/1979 | Fed. Rep. of Germany | 272/117 |
| 3445104 | 6/1986 | Fed. Rep. of Germany | 272/118 |

*Primary Examiner*—Robert Bahr

*Attorney, Agent, or Firm*—Webb, Burden, Ziesenheim & Webb

[57] ABSTRACT

An exercise device having a frame, a seat and a back rest mounted on the frame and a weight stack having a plurality of movable weights. An elongated resistance convertor arm is rotatably mounted on the frame and a cable having one end connected to the weights in the weight stack and the other end connected to the resistance converter arm. A movable contact member adapted to be moved by a user of the exercise device is rotatably mounted on the frame and an adjustment disk connects the contact member and the resistance convertor arm so that the relative angular position of the resistance convertor arm and the horizontal plane including the contact member can be varied to change the pattern of resistance to movement of the contact member.

6 Claims, 3 Drawing Sheets

EXERCISE DEVICE

BACKGROUND OF THE INVENTION

1. Field of the Invention

The invention relates generally to an exercise device and more particularly to an exercise device wherein the pattern of resistance required by the user to move the contact member can be varied without adding or removing individual weights.

Exercise devices and rehabilitation machines are used to improve the overall health and fitness of the human body and to increase strength. A disadvantage of the present devices is that they require the user to change the amount of weight which resists the force which the user places on the machine, and hence, the user must interrupt the exercising program. Moreover, the existing devices are not designed to vary the pattern of the resistance during an individual movement of the contact member by the user of the device. The known devices do not have the desired versatility. The present invention overcomes the deficiencies which are inherent in the prior art devices by incorporating a simple adjustment arrangement.

2. Description of the Prior Art

Various prior art patents such as, for example, U.S. Pat. Nos. 4,709,920 and 4,256,302 disclose arrangements wherein the force required to be exerted on the bar is varied by changing the position of cam arrangements but these devices are complicated and do not permit the versatility which is desired in incrementally varying the amount of resistance to movement of the contact member.

Other United States patents, such as, for example, U.S. Pat. Nos. 4,763,897; 4,407,495; 3,640,527; 4,603,855 and 4,511,137 disclose adjusting the resistance required to move the weights but do not have any mechanism to vary the pattern of resistance.

SUMMARY OF THE INVENTION

The present invention is a variable resistance exercise device which has all of the advantages of the prior art devices and the further advantage of being readily adjustable to vary the pattern of the resistance to the force applied to the contact member to move it. The device may be used to exercise the arms, legs, shoulders, stomach and back without making any complicated changes in the device. The resistance pattern variation is accomplished by adjusting the angular position of the end of the cable which lifts the weights relative to the horizontal plane including the contact member. The position of the end of the cable is changed by adjusting the position of a resistance convertor arm relative to the horizontal plane which includes the contact member. Simple adjustments can be made permitting the user of the device to determine the pattern of resistance which is imposed upon the contact member during each cycle of movement.

DESCRIPTION OF THE PREFERRED EMBODIMENT

Figure 1:
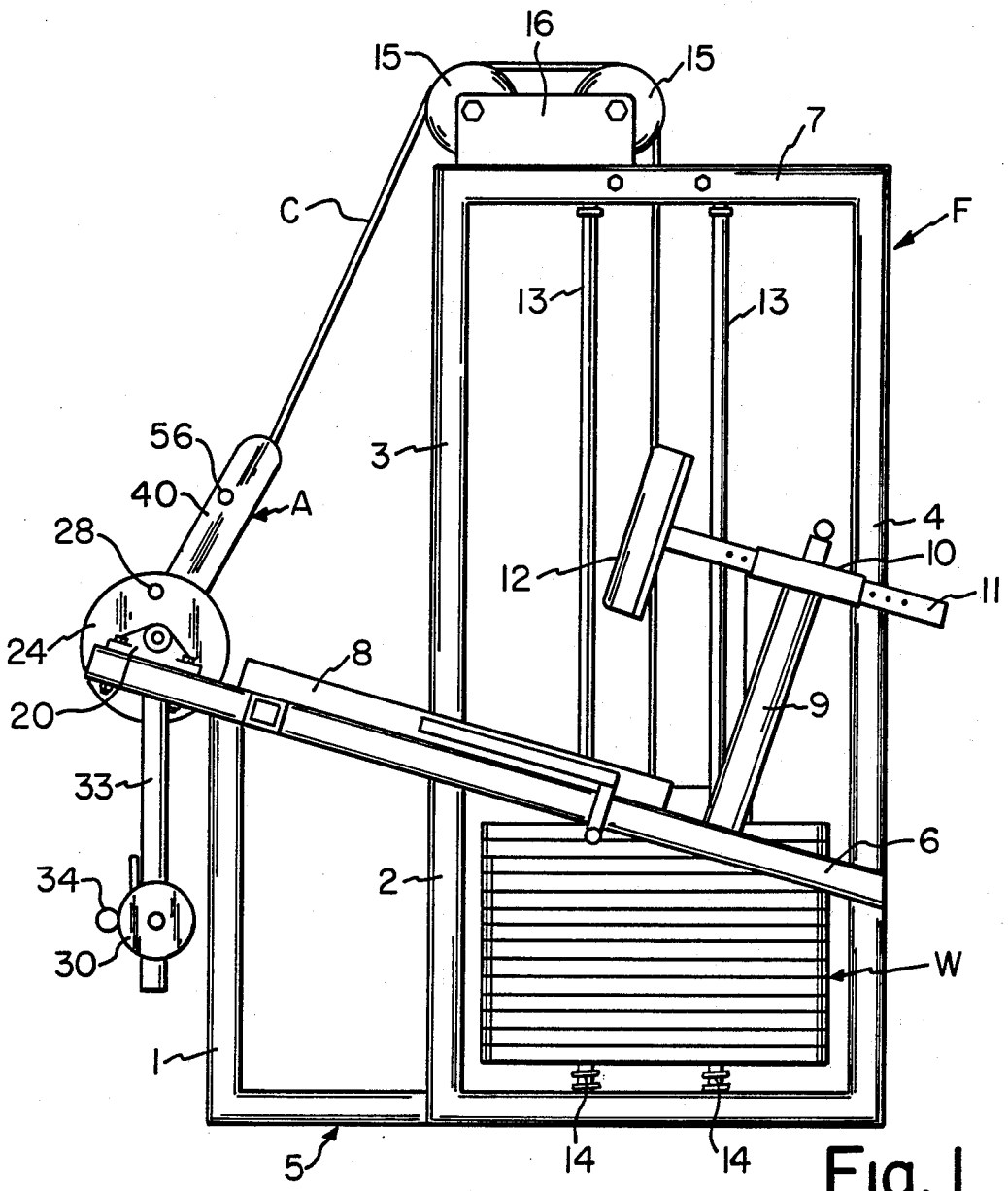
FIG. 1 is a side elevation of the exercise device of the present invention.
Figure 3:
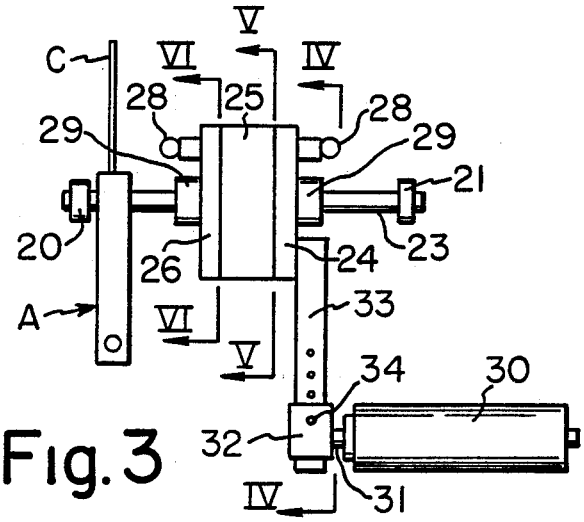
FIG. 3 is a schematic diagram of the contact member and the resistance adjustment mechanism of the exercise device.
Figure 4:
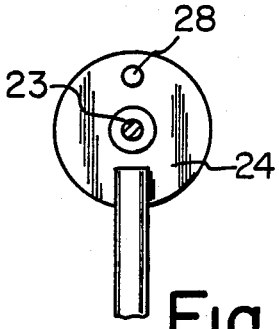
FIG. 4 is a section on line IV—IV of FIG. 3.
Figure 2:
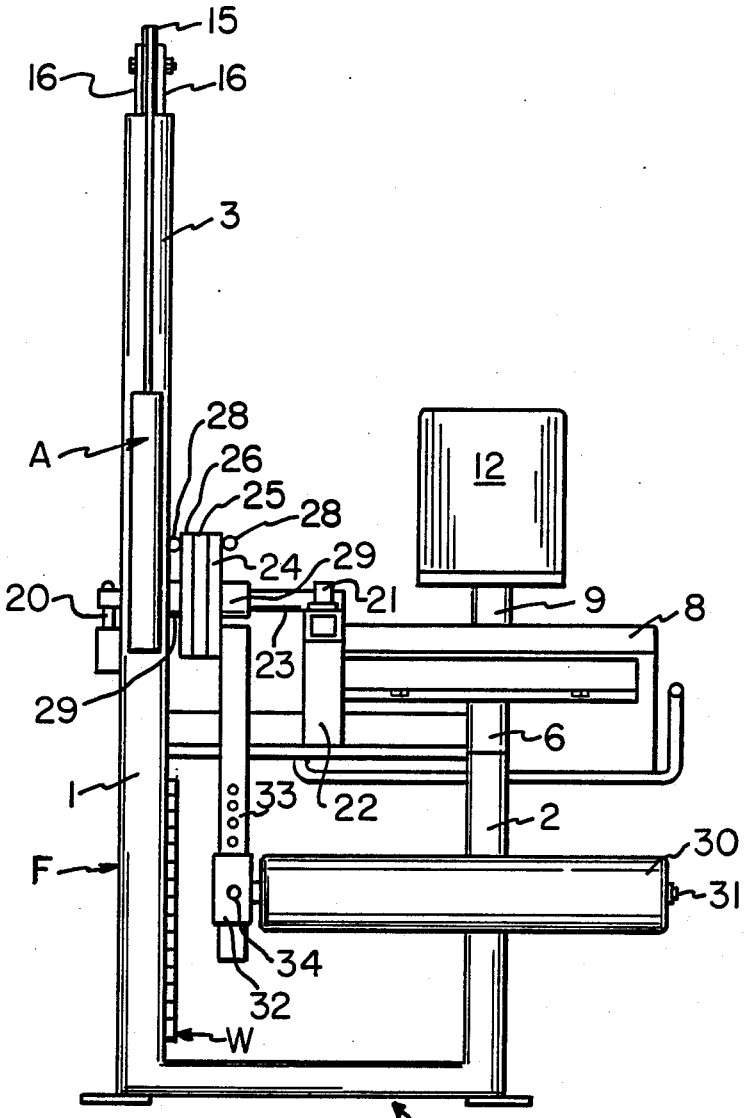
FIG. 2 is a front elevation of the exercise device of the present invention.
Figure 5:
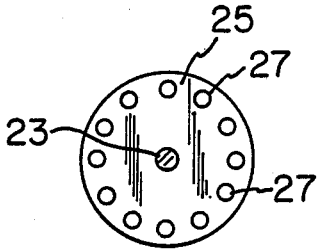
FIG. 5 is a section on line V—V of FIG. 3.
Figure 6:
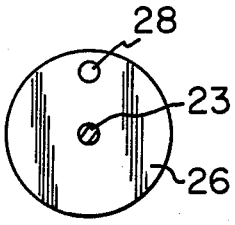
FIG. 6 is a section on line VI—VI of FIG. 3.

With reference to FIGS. 1 and 2 of the drawings, the exercise device has a substantially rigid frame F which includes vertical members 1, 2, 3 and 4; a horizontal base 5; an angular support member 6 and an upper member 7. A seat 8 is supported on frame member 6 and a support member 9 extends upwardly from and has its lower end welded to support member 6. A hollow tube 10 is welded to the upper end of support member 9 and a member 11 having a back rest 12 attached thereto is adjustably supported in tube 10. A standard weight stack W is located between frame members 1 and 4. The individual weights are aligned on a pair of guide rods 13 and may be individually attached to a lifting member which has its upper end connected to one end of a substantially inelastic flexible cable C. Shock absorbers 14 are located on base 5 at the lower end of each guide rod. The cable C extends upwardly from the weight stack and passes over a pair of spaced pulleys 15 which are supported by bracket members 16 attached to horizontal frame member 7 The free end of cable C is attached to a resistance convertor arm A which is described in detail hereinafter.

A standard bearing 20 is supported on the frame member 1 in spaced relation to a standard bearing 21 which is supported on a frame member 22. Bearings 20 and 21 are horizontally aligned and a rotatable shaft 23 is supported by the bearings. A disk 24 is rotatably mounted on shaft 23 and an adjustment disk 25 is located adjacent to one face of disk 24 and is fixed to shaft 23. A disk 26 is located adjacent to the side of adjustment disk 25 opposite to the side facing disk 24 and is rotatably mounted on shaft 23. The adjustment disk 25 is formed with a plurality of spaced holes 27 around its circumference and each of disks 24 and 26 have a spring loaded pop pin 28 mounted therein. The pop pins are adapted to engage one of the holes 27 in adjustment disk 25 to adjust the position of disks 24 and 26 relative to adjustment disk 25. A pair of collars 29 hold the disks 24 and 26 on shaft 23 adjacent to the opposite sides of adjustment disk 25.

A contact member 30 is rotatably mounted on a substantially horizontal shaft 31 which is attached to a hollow tube 32. The tube fits around a shaft 33 so that the position of the contact member can be vertically adjusted relative to the seat 8 to accommodate different users and different exercises. A spring loaded pop pin 34 is mounted in tube 32 for adjusting the position of tube 32 along shaft 33. The end of shaft 33 opposite the end which supports tube 32 is fixed to disk 24.

The resistance convertor arm A is a hollow square tube and one end is fixed to shaft 23 between bearing 20 and disk 26. The resistance convertor arm is shown in detail in FIGS. 7–10 of the drawings. The end of cable C is fixed within the resistance convertor arm and the cable extends out of the free end of the arm. When a user of the exercise device moves contact member 30, the shaft 23 is rotated by adjustment disk 25 which is fixed to shaft 23 and is pinned to disks 24 and 26 by pop pins 28. Rotation of the resistance convertor arm moves the cable C and lifts the weights in the weight stack. The angular position of the resistance convertor arm can be adjusted relative to the horizontal plane including contact member 30 when the contact member is in the static position by pulling out pop pins 28 and rotating the resistance convertor arm and shaft 23 into the desired position relative to the horizontal plane including the contact member to change the pattern of the resistance of the contact member required to lift the weights in the weight stack W. When shaft 23 and resistance convertor arm A are rotated, adjustment disk 25 is also rotated while disks 24 and 26 remain in place. When the resistance convertor arm is properly positioned, pop pins 28 are inserted into the adjacent hole 27 in adjustment disk 25 and the exercise device is ready for use.

Figure 11:
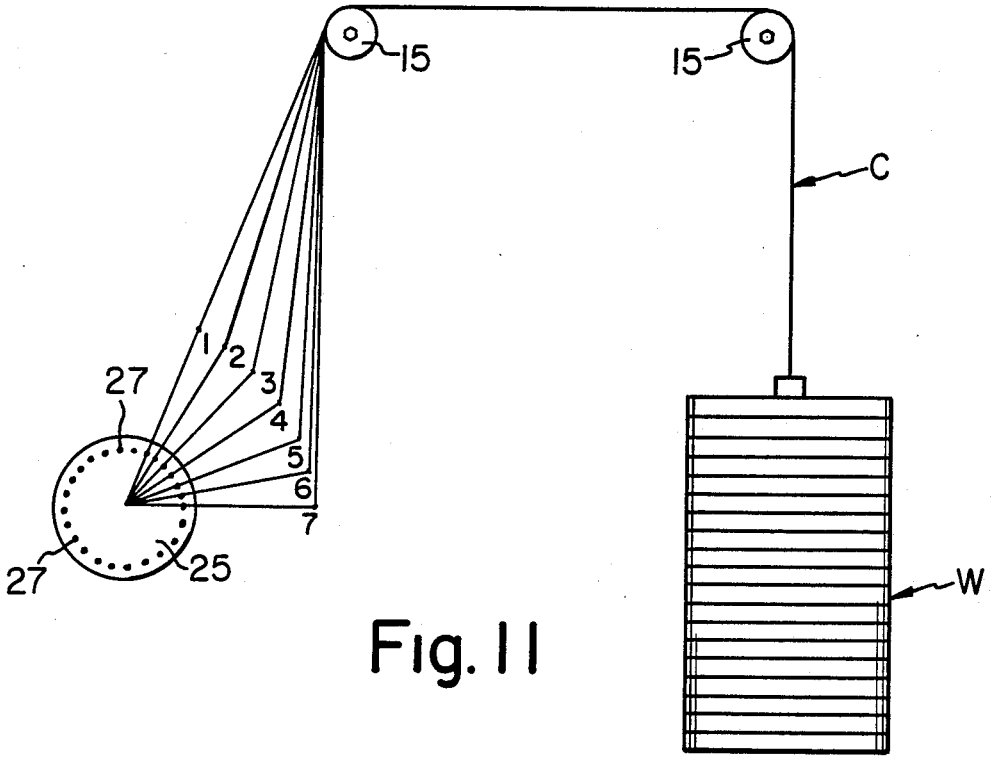
FIG. 11 is a schematic diagram showing different exemplary positions of the resistance convertor arm to vary the resistance of the contact member to movement.

In the exemplary arrangement shown in FIG. 11 of the drawings, the resistance may be varied according to the following relationship:

| POSITION OF ARM | RESISTANCE TO MOVEMENT (LBS) 15 LBS Weight | 150 LBS Weight | 300 LBS Weight |
|---|---|---|---|
| 1 | 1.50 | 15.0 | 30.0 |
| 2 | 3.75 | 37.5 | 75.0 |
| 3 | 6.00 | 60.0 | 120.0 |
| 4 | 8.25 | 82.5 | 165.0 |
| 5 | 10.50 | 105.0 | 210.0 |
| 6 | 12.75 | 127.5 | 255.0 |
| 7 | 15.00 | 150.0 | 300.0 |

While seven positions of the resistance convertor arm are shown in FIG. 11 of the drawings, it will be understood by those skilled in the art that there may be a greater or a fewer number of holes 27 located around the periphery of adjustment disk 25 to receive pop pins 28 to determine the position of the resistance convertor arm relative to the horizontal plane including contact member 30.

The angular position of the resistance convertor arm relative to the horizontal plane including the contact member is varied depending upon the strength of the user, the type of exercise to be performed and the number of repetitions desired. By changing the resistance to movement of the contact member, it is possible to concentrate on strengthening different muscles and in increasing the rate of recovery for patients using the exercise device for rehabilitation.

Figure 7:
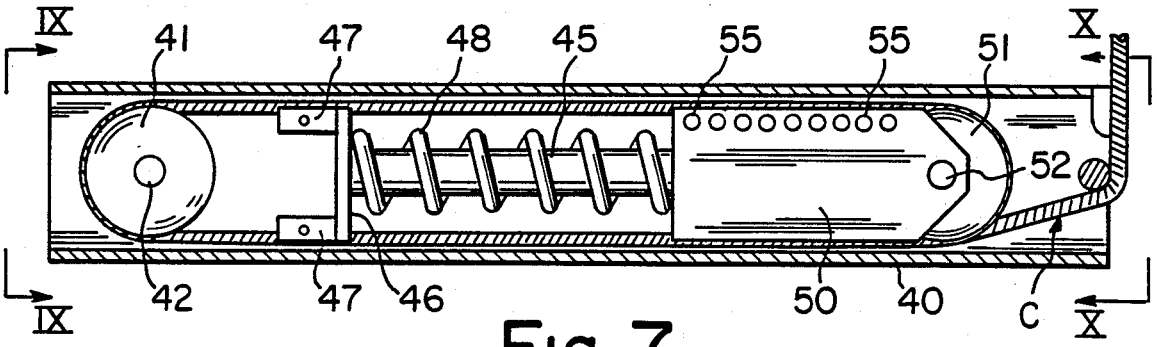
FIG. 7 is a vertical section through the resistance convertor arm of the exercise device.
Figure 8:
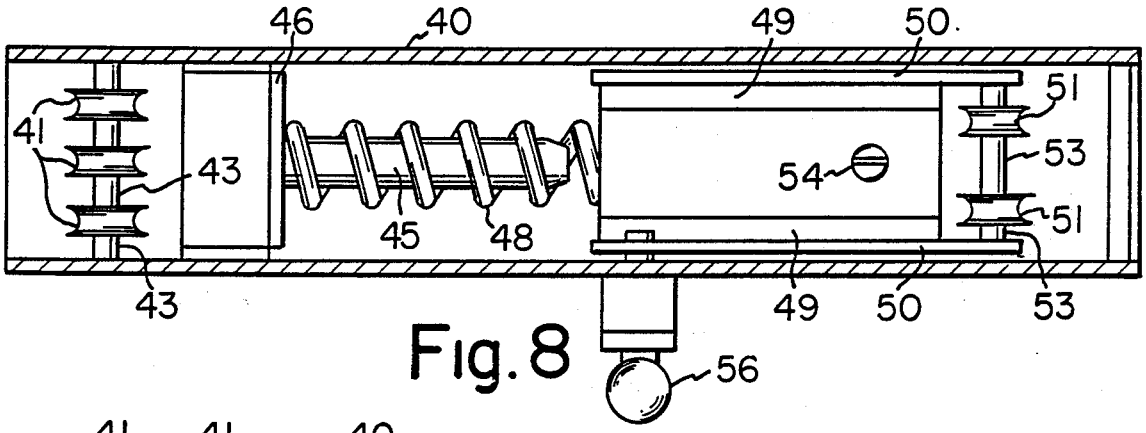
FIG. 8 is a horizontal section through the resistance convertor arm of the exercise device.
Figure 9:
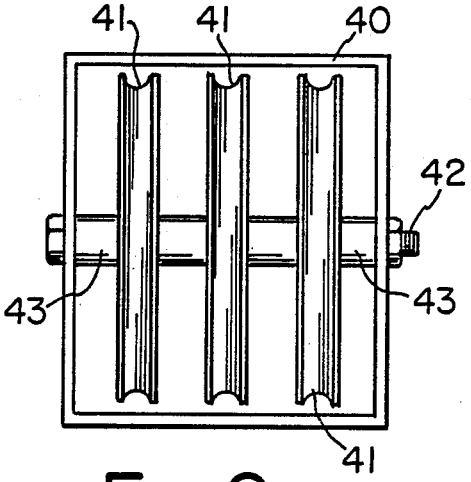
FIG. 9 is an end view on line IX—IX of FIG. 7 with the cable removed.
Figure 10:
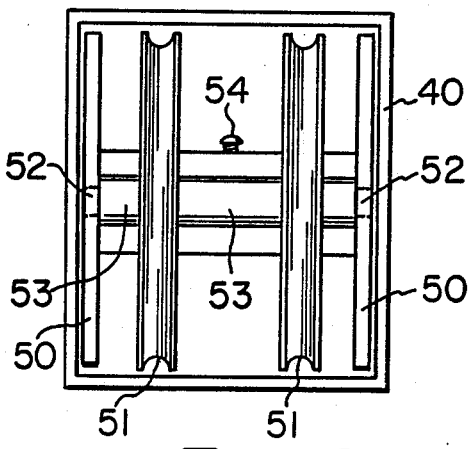
FIG. 10 is an end view on line X—X of FIG. 7 with the cable removed.

Because the angular position of the free end of the resistance convertor arm is adjustable, it is necessary that the resistance convertor arm includes the cable takeup arrangement shown in FIGS. 7–10 of the drawings. As shown in FIGS. 7 and 8 of the drawings, the resistance convertor arm A is an elongated square, hollow tubular member 40. Spaced pulleys 41 for cable C are rotatably mounted on an axle 42 which is carried by the end of member 40 which is fixed to shaft 23. As shown in FIG. 9 of the drawings, the pulleys 41 are spaced apart on axle 42 by spacers 43 so that they retain the proper spacing during operation. A shaft 45 is located on the longitudinal axis of tube 40 and one end is attached to a lateral plate 46 welded to mounting blocks 47 attached to the walls of tube 40. Shaft 45 extends toward the end of the tube opposite pulleys 41. A coil spring 48 surrounds shaft 45 throughout its length and extends within an inner slidable member 49. A set screw 54 holds the end of spring 48 in position in the inner slidable member 49. The inner slidable member has a longitudinal plate 50 welded to each side and a pair of pulleys 51 are mounted on an axle 52 which is carried by plates 50. The pulleys 51 are held in the proper position on axle 52 by spacers 53. One plate 50 is formed along its upper edge with a plurality of spaced holes 55 and a spring loaded pop pin 56 is mounted on one side of the tube 40 and is adapted to extend into one of the holes 55 to properly position the pulleys 51 along the length of tube 40.

The location of the slidable member 49 inside tube 40 is determined by the angular position of the resistance convertor arm which varies the length of the cable extending between the lifting member for the weights and the end of the resistance convertor arm when the exercise device is in the static condition. The cable passes around the pulleys 41 and 51 and the location of the pulleys 51 is changed relative to the pulleys 41 with pop pin 56 pulled out. After the cable length is changed, pop pin 56 is permitted to snap into the adjacent hole 55 in plate 50 to hold pulleys 51 in the proper position.

The arrangement of the exercise device of the invention which is shown in FIGS. 1 and 2 of the drawings may be used for leg extensions. The exercise device may be adjusted for leg curls, abdominal exercises, back extensions, leg presses, hack squats, lat pulldowns or any other type of exercise. The exercise device according to the invention permits ready and easy adjustment of the pattern of the resistance required to lift the weights in the weight stack by changing the position of the resistance convertor arm. The total resistance of the contact member is determined by the amount of weight selected from the weight stack. Hence, the device is more practical than exercise machines wherein it is necessary to remove and add individual weights or perform other complex adjustments to change the resistance of the contact member against which the user must exercise.

Having described a presently preferred embodiment of the invention, it is to be understood that it may be otherwise embodied within the scope of the appended claims.

I claim:

1. An exercise device including a frame, a seat mounted on said frame, a weight stack having a plurality of movable weights, an elongated resistance convertor arm in the form of a hollow tubular member having a first end and a second end, means rotatably mounting said first end of said resistance convertor arm on said frame, cable means having a first end connected to weights in said weight stack and a second end connected to said second end of said resistance convertor arm, said resistance convertor arm including take up means located within said tubular member to constantly maintain said cable in a substantially taut condition between said second end of said resistance convertor arm and said weight stack regardless of the distance between said weight stack and said second end of said resistance convertor arm, a movable contact member adapted to be moved by a user of the exercise device, means for rotatably mounting said contact member on said frame and adjustment means for operatively connecting said contact member and said resistance convertor arm, said take up means including first pulley means adjacent to said first end of said tubular member and second pulley means adjacent to said second end of said tubular member, said second pulley means being mounted on adjustment means for varying the location of said second pulley means along the length of said tubular member, whereby the relative angular position of said second end of said resistance convertor arm and the horizontal plane including said contact member can be varied to change the pattern of the resistance to movement of said contact member, the second pulley means being adapted to be moved longitudinally along said resistance convertor arm according to the position of said resistance convertor arm relative to the plane including said contact member.

2. An exercise device as set forth in claim 1, wherein said adjustment means is a slidable member located in said tubular member and means for maintaining said slidable member in position after said resistance convertor arm is positioned in the desired location are supported on said tubular member.

3. An exercise device as set forth in claim 1, wherein said slidable member is operatively connected to a coil spring located in said tubular member and said coil spring resists movement of said slidable member within said tubular member until the position of said resistance convertor arm relative to the horizontal plane including said contact member is changed.

4. An exercise device as set forth in claim 1, wherein said means for rotatably mounting said contact member on said frame include a shaft having an upper end connected to said adjustment means and a lower end formed with a plurality of longitudinally aligned spaced holes, a movable tube surrounding said lower end of said shaft, a spring loaded pop pin carried by said tube adapted to snap into one of said holes and a shaft connecting said contact member to said tube, whereby said tube is adjustable along said shaft to change the location of said contact member relative to said seat.

5. An exercise device as set forth in claim 1, including a back rest, means for adjustably mounting said seat on said frame, whereby the position of said back rest can be changed relative to said seat.

6. An exercise device as set forth in claim 1, including spaced aligned bearings mounted on said frame and said rotatable shaft is mounted in said spaced aligned bearings.

* * * * *